US005308725A

United States Patent [19]

Yu et al.

[11] Patent Number: 5,308,725

[45] Date of Patent: May 3, 1994

[54] FLEXIBLE BELT SUPPORTED BY FLEXIBLE SUBSTRATE CARRIER SLEEVE

[75] Inventors: Robert C. U. Yu, Webster; Geoffrey M. T. Foley, Fairport; William G. Herbert, Williamson; William W. Limburg, Penfield; Satchidanand Mishra, Webster; Richard L. Post, Penfield; Donald C. VonHoene, Fairfield, all of N.Y.

[73] Assignee: Xerox Corporation, Stamford, Conn.

[21] Appl. No.: 953,038

[22] Filed: Sep. 29, 1992

[51] Int. Cl.[5] ..... G03G 15/00

[52] U.S. Cl. ..... 430/56; 355/213; 198/845

[58] Field of Search ..... 430/56, 69; 355/212, 355/213; 198/847, 845

[56] References Cited

U.S. PATENT DOCUMENTS

| | | | |
|---|---|---|---|
| 632,750 | 9/1899 | Ridgway | 198/847 |
| 4,192,603 | 3/1980 | Buck | 355/212 |
| 4,198,155 | 4/1980 | Silverberg | 355/212 |
| 4,711,833 | 12/1987 | McAneney et al. | 430/131 |
| 4,747,992 | 5/1988 | Sypula et al. | 264/130 |
| 5,039,598 | 8/1991 | Abramsohn et al. | 430/347 |
| 5,070,365 | 12/1991 | Agarwal | 355/212 |
| 5,073,434 | 12/1991 | Frank et al. | 428/195 |
| 5,100,628 | 3/1992 | Griffiths et al. | 427/121 |

*Primary Examiner*—John Goodrow

[57] ABSTRACT

A process including providing at least two support members maintained at a predetermined distance from each other, encircling the support members with at least one loosely hanging preformed flexible seamless carrier support sleeve having a predetermined outer circumference, encircling the seamless carrier support sleeve with a flexible belt having an inner circumference substantially same as or less than the predetermined outer circumference of the seamless carrier support sleeve, and increasing the distance between the support members to stretch the flexible belt, the size of the inner circumference of the stretched flexible belt being substantially equal to the outer circumference of the seamless carrier support sleeve after stretching the flexible belt. The resulting flexible belt assembly fabricated by this process may be utilized in various systems including electrostatographic imaging systems.

20 Claims, 2 Drawing Sheets

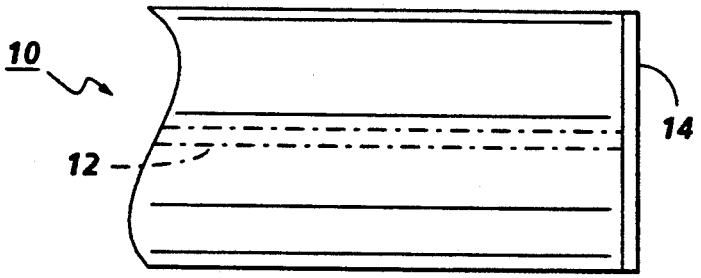
FIG. 1
FIG. 2
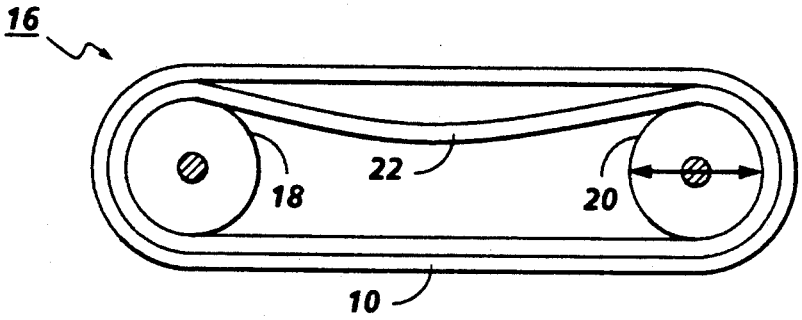
FIG. 3
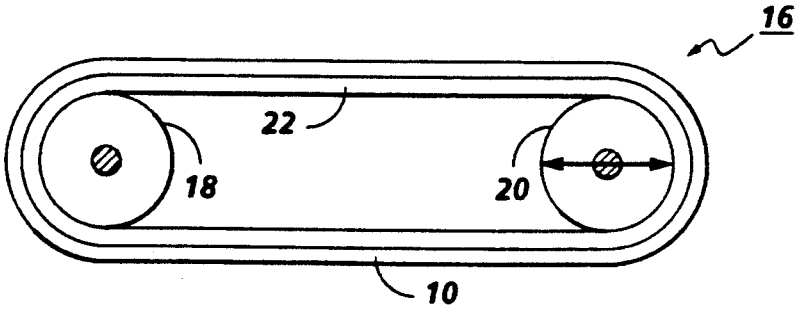

FLEXIBLE BELT SUPPORTED BY FLEXIBLE SUBSTRATE CARRIER SLEEVE

BACKGROUND OF THE INVENTION

This invention relates in general to flexible assembly devices comprising a flexible belt supported by a flexible seamless carrier support sleeve and methods of using the assembly devices.

Coated flexible belts or tubes are commonly utilized for numerous purposes such as electrostatographic imaging members, conveyor belts, drive belts, intermediate image transfer belts, sheet transport belts, document handling belts, and the like.

Flexible electrostatographic imaging members, e.g. belts, are well known in the art. Typical electrostatographic flexible imaging members include, for example, photoreceptors for electrophotographic imaging systems, and electroreceptors or ionographic imaging members for electrographic imaging systems. Both electrophotographic and ionographic imaging members are commonly utilized in a belt configuration. These electrostatographic imaging member belts may be seamless or seamed. For electrophotographic applications, the imaging members preferably have a belt configuration. These belts often comprise a flexible substrate coated with one or more layers of photoconductive material. The substrates are usually organic materials such as a film forming polymer. The photoconductive coatings applied to these substrates may be inorganic such as selenium or selenium alloys or organic. The organic photoconductive layers may comprise, for example, single binder layers in which photoconductive particles are dispersed in a film forming binder or multilayers comprising, for example, a charge generating layer and a charge transport layer.

Electrophotographic imaging members having a belt configuration are normally entrained around and supported by at least two belt rollers in an electrophotographic imaging machine. Generally, one of the rollers is driven by a motor to transport the belt around the rollers during electrophotographic imaging cycles. Since electrophotographic imaging belts, particularly welded seam belts, are not perfectly cylindrical and, more specifically, tend to be slightly cone shaped, these flexible belts tend to "walk" axially along the support rollers. Belt walking causes one edge of the belt to strike one or more edge guides positioned adjacent the ends of the rollers to limit axial movement. Friction between the edge guide and the edge of the imaging belt can cause the belt to wear, rip, buckle, delaminate and otherwise damage the belt.

Imaging belts driven around supporting rollers can slip relative to the surface of the roller during stop and go operations. Belt slipping has been a serious problem when the surface contact friction between the backside of the imaging belt and the elastomeric outer surface of the drive roll is substantially reduced as a result of aging of the elastomeric material or deposition and accumulation of undesirable foreign material on the surface of the drive roll. This slippage can adversely affect registration of images, particularly where multiple, sequentially formed and transferred images must be precisely registered with each other in demanding applications such as color imaging process. Further, when welded imaging belt seams encounter slippage, sophisticated detection systems are required to ensure that images are not formed on the seam when the position of the seam shifts due to slippage. Also, there are other serious drawbacks in terms of belt tracking and problems with good image registration. Welded imaging belts, because of the difficulties associated with perfectly aligning overlapping ends during seam welding, are not as concentric as desired.

Often, the supporting rollers for an electrophotographic imaging belt have a tendency to accumulate dirt or particulates on their surfaces to cause localized particle protrusions and form stress concentration spots in the imaging belt, thereby exacerbating the development of premature mechanical failure. Constant flexing of the belt around these support rollers during machine function can result in imaging belt surface cracking. Cracking of the outer imaging layer leads to copy print defects.

Moreover, the region of a belt located between supporting rollers can vibrate and undesirably alter the often critical distances between the belt imaging surface and devices such as optical exposure means, charging corotrons, development applicators, transfer stations and the like.

In addition, the anti-curl back coating on an imaging belt tends to wear during machine cycling and such wear reduces the effectiveness of the anti-curl back coating from preventing curling of the edges of the belt. Curling of the belt also adversely affects the critical distances between the belt imaging surface and adjacent processing stations.

Attempts to prepare electrostatographic imaging belts using a thick supporting substrate to provide satisfactory beam rigidity and eliminate the need of an anti-curl back coating have been seen to accelerate the onset of dynamic fatigue outer imaging layer cracking, since the added imaging member thickness increases its bending stress when flexed over the machine belt module rollers.

When cycled in a machine, an imaging belt is constantly subjected to an applied 1 lb/in (178.6 gms/cm) belt tension. Belt creep, as a function of time in service and the applied tension, is very undesirable because it promotes imaging belt cracking and shortens its service life.

INFORMATION DISCLOSURE STATEMENT

U.S. Pat. No. 4,711,833 issued to T. McAneney et al on Dec. 8, 1987 —A process is disclosed for fabricating seamless belts comprising providing a mandrel coated with a release coating, depositing a polymer by electrostatic spraying, melting the polymer and cooling the polymer. The resulting seamless belt is removed from the mandrel prior to or after application of a ground plane layer, photogenerating layer and charge generating layer. After formation of the coated or uncoated belt, air pressure is applied to the interior of the mandrel. The air passes through holes at one end of the mandrel to lift and break the adhesive bond between the inside surface of the seamless coated or uncoated belt and the mandrel surface. The air pressure is then released and the seamless coated or uncoated belt is easily slipped off the mandrel.

U.S. Pat. No. 4,747,992 issued D. Sypula to et al on May 31, 1988—A process is disclosed for forming a seamless belt comprising forming at least one thin uniform fluid coating of a film forming polymer on a cylindrical mandrel having a larger mass, lower thermal conductivity or larger mass and lower thermal conductivity than the film forming polymer and a critical surface tension greater than the surface tension of the fluid coating to form at least one thin coating around the mandrel, heating both the mandrel and the coating to a temperature above the apparent $T_g$ of the solid coating to expand the coating and mandrel, cooling the coating below the apparent $T_g$ of the solid coating prior to substantial cooling of the mandrel, cooling the mandrel whereby the mandrel contracts at a greater rate than the coating until separation occurs between the mandrel, and removing the coating from the mandrel. A fluid of air or liquid may be introduced at one or both ends of the mandrel between the mandrel surface and the deposited belt to reduce adhesion between the mandrel and the coating prior to removing the coating from the mandrel.

U.S. Pat. No. 5,039,598 issued to Abramsohn et al. on Aug. 13, 1991—A process is disclosed for preparing ionographic imaging members including providing a flexible-shrinkable tube containing a dielectric film forming polymer having a certain $T_g$, charge decade and elastic memory properties, providing a cylindrical support member having an outer diameter that is less than the inner diameter of the flexible tube, applying a continuous coating of the interior of the tube or the exterior the cylindrical support member, the coating comprising an electrically conductive material, an adhesive material or mixture thereof, shrinking the tube to bring the inner surface of the tube and the outer surface of the cylindrical support member into intimate physical contact with the continuous coating. The tube may be worked to expand the diameter so that it will fit over a cylindrical metal or conductive roll substrate. For example, one may inflate an elastomeric tube with the pressurized fluid by sealing one end of the tube and introducing the pressurized fluid into the interior of the tube through the other end. For example, one may seal the end of the tube by inserting a tapered stopper, or by pinching or heat sealing the end and later trimming the end to fix the substrate. The cylindrical support member can thereafter be inserted within the flexible tube while the tube is in the inflated state. Subsequent removal of the pressurized fluid allows the tube to shrink around the cylindrical support member.

U.S. Pat. No. 5,073,434 issued to J. Frank et al. on Dec. 17, 1991—An ionographic imaging member is disclosed containing a conductive layer and a uniform continuous dielectric imaging layer, the imaging layer having a certain dielectric constant, thickness relationship.

U.S. Pat. No. 5,100,628 issued to C. Griffiths et al. on Mar. 21, 1992—A method and apparatus for coating photoreceptors using copying machines is disclosed in which, prior to coating, an elastically deformable material is placed around the external surface of mandrel to accommodate a belt. The thickness of the material is such that when the belt is pushed over the mandrel the deformable material is deformed and engages the interior surfaces of the belt facing the mandrel. As a result of heating and cooling steps involved during the coating process the belt contracts and expands differently than the mandrel. After coating, the coated belt is removed from the mandrel.

Thus, there is a continuing need for improving the functional life of flexible devices, particularly electrostatographic imaging members belts having improved electrostatographic imaging properties.

SUMMARY OF THE INVENTION

It is, therefore, an object of the present invention to provide an improved method for fabricating flexible belt assembly devices and products that overcome the above-noted disadvantages.

It is another object of the present invention to provide an improved flexible belt assembly devices, particularly electrostatographic imaging members, that maintains the best attributes of a belt design without the stated shortcomings.

It is yet another object of the present invention to provide an improved flexible belt assembly devices, particularly electrostatographic imaging members, utilizing a flexible belt that exhibits superior tracking during cycling.

It is a further object of the present invention to provide an improved flexible belt assembly devices, particularly electrostatographic imaging members belt, having extended functional life.

It is still another object of the present invention to provide an improved flexible electrostatographic imaging member belt assembly devices which facilitate registration of images.

It is still yet another object of the present invention to minimize or eliminate electrostatographic imaging member belt creep in a service environment.

It is a further object of the present invention to provide an improved flexible electrostatographic imaging member belt assembly devices which exhibit longer life when exposed to dynamic fatigue cycling over supporting rollers.

It is yet another object of the present invention to provide improved flexible belt assembly devices that can more readily be precisely cycled.

The foregoing objects and others are accomplished in accordance with this invention by providing at least two support members maintained at a predetermined distance from each other, encircling the support members with at least one loosely hanging preformed flexible seamless carrier support sleeve having a predetermined outer circumference, encircling the seamless carrier support sleeve with a flexible belt having an inner circumference substantially same as or less than the predetermined outer circumference of the seamless carrier support sleeve, and increasing the distance between the support members to stretch the flexible belt, the size of the inner circumference of the stretched flexible belt being substantially equal to the outer circumference of the seamless carrier support sleeve after stretching the flexible belt. The resulting flexible belt assembly fabricated by this process may be utilized in various systems including electrostatographic imaging systems.

BRIEF DESCRIPTION OF THE DRAWINGS

A more complete understanding of the device and process of the present invention can be obtained by reference to the accompanying drawings wherein:

FIG. 1 is a schematic illustration of a section of a seamed flexible electrostatographic imaging member belt.

FIG. 2 is a schematic illustration of a flexible electrostatographic imaging member belt encircling a loosely hanging flexible seamless carrier support sleeve mounted on two support members.

FIG. 3 is a schematic illustration of a flexible electrostatographic imaging member belt encircling a flexible seamless carrier support sleeve after one of two support members has been moved apart from the other.

Figure 4:
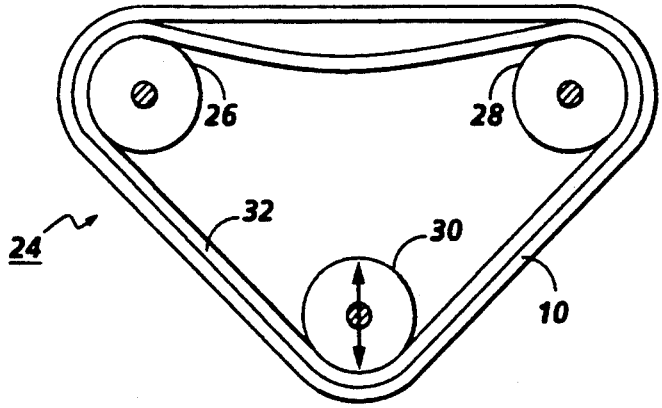
FIG. 4 is a schematic illustration of a flexible electrostatographic imaging member belt encircling a loosely hanging flexible seamless carrier support sleeve mounted on three support members.

These figures merely schematically illustrate the invention and are not intended to indicate relative size and dimensions of the imaging belt, seamless carrier support sleeve or components thereof.

DETAILED DESCRIPTION OF THE DRAWINGS

For the sake of convenience, the invention will be described in relation to fabrication of belt assembly devices comprising a preformed flexible seamless carrier support sleeve having at least one distinct outer encircling belt such as a flexible electrostatographic imaging belt under tension. The invention, however, is applicable to other cylindrical devices comprising a flexible seamless carrier support sleeve having at least one distinct outer flexible belt such as an intermediate image transfer belt, sheet transport belt, document handler belt, conveyor belt, drive belt and the like.

Referring to FIG. 1, a flexible seamed electrostatographic imaging belt 10 is shown having a welded seam 12 extending transversely across the width of belt 10 and an electrically conductive ground strip 14 along one edge.

In FIG. 2, a belt assembly device 16 is illustrated. Belt assembly device 16 comprises two parallel support rollers 18 and 20 maintained at a predetermined distance from each other. Encircling both support rollers 18 and 20 is a loosely hanging preformed flexible seamless carrier support sleeve 22. At least one of the support rollers such as roller 18 may be a drive roll driven by suitable means such as an electric motor (not shown). Roller 20 is movable in the directions shown by the arrows. Carrier support sleeve 22 is encircled by flexible seamed electrostatographic imaging belt 10 having an inner circumference smaller than the outer circumference of loosely hanging support sleeve 22.

Referring to FIG. 3, the original distance between rollers 18 and 20 (shown in FIG. 2) is increased by moving roller 20 away from roller 18 until the inner circumference of imaging belt 10 is substantially equal to the outer circumference of carrier support sleeve 22. This stretches the imaging belt 10, i.e. subjects belt 10 to tension stretch. Under these conditions, the carrier support sleeve 22 may also be subjected to tension stretch or merely reshaped to remove any slack while being free of any applied tension stretch, the latter being preferred for optimum tracking.

In FIG. 4, a belt assembly device 24 is shown. Belt assembly device 24 comprises three parallel support rollers 26, 28 and 30 maintained at a predetermined distance from each other. Encircling all three support rollers 26, 28 and 30 is a loosely hanging preformed flexible seamless carrier support sleeve 32. At least one of the support rollers such as roller 26 or roller 28 may be driven by a suitable means such as an electric motor (not shown). Roller 30 is movable in the directions shown by the arrows. Carrier support sleeve 32 is encircled by flexible seamed electrostatographic imaging belt 10 having an inner circumference smaller than the outer circumference of loosely hanging support sleeve 32.

Figure 5:
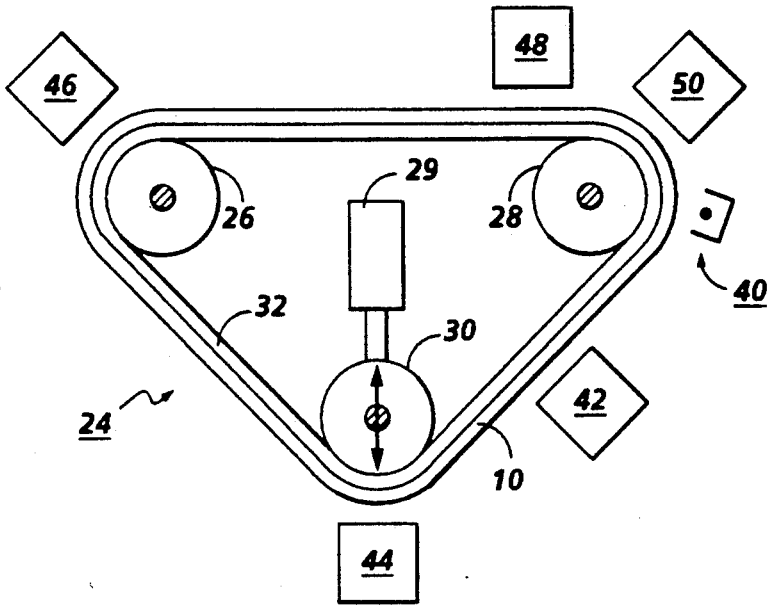
FIG. 5 is a schematic illustration of a flexible electrostatographic imaging member belt encircling a loosely hanging flexible seamless carrier support sleeve mounted on three support members after one of the support members have been moved away from the other two.

Referring to FIG. 5, the original distance between roller 30 from rollers 26 and 28 (shown in FIG. 4) is increased by moving roller 30 away from rollers 26 and 28 by any suitable means such as a two-way acting air cylinder 29 until the inner circumference of imaging belt 10 is substantially equal to the outer circumference of carrier support sleeve 32. Although the increase in distance shown in FIG. 5 between roller 30 and roller 26 is the same as the increase in distance between roller 30 and roller 28, the distance need not be equal. Further, if desired, the distance between roller 30 and roller 26 can be increased while the distance between roller 30 and roller 28 remains unchanged or is reduced slightly. The direction and distance of movement of roller 30 should, however, be sufficient to stretch the inner circumference of imaging belt 10 until it is substantially equal to the outer circumference of carrier support sleeve 32. Under these conditions, the carrier support sleeve 32 may also be subjected to tension stretch or merely reshaped to remove any slack while still being free of any applied tension stretch, the latter being preferred for optimum tracking. More than three support rollers may be utilized (not shown) if desired. Conventional image processing stations (not shown) may be utilized around the periphery of belt assembly device 24 as illustrated in FIG. 5. Typical electrophotographic image processing stations include charging station 40, image exposure station 42, image development station 44, toner image transfer station 46, cleaning station 48 and discharge station 50 which are well known in the art. Similarly where an electrographic system is employed, conventional image processing stations such as an electrostatic image forming station, image development station, toner image transfer station, cleaning station and discharge station may be arranged around the periphery of belt assembly device 24.

Any suitable thin flexible belt may be mounted on the flexible seamless carrier support sleeve. Flexible belts, such as thin electrostatographic imaging belts, are well known in the art. Typical thin flexible electrophotographic imaging belts are described, for example, in U.S. Pat. Nos. 4,265,990, 4,747,992, 4,711,833 and 3,713,821, the entire disclosures of these patents being incorporated herein by reference. The flexible imaging belt may have a welded seam or may be seamless. The imaging belt should be flexible and stretchable. The expression "flexible", as used herein, is defined as bendable without exhibiting mechanical failure such as when cycled around various sizes of conventional support rollers during electrostatographic imaging in an automatic copier, duplicator or printer. The word "stretchable", as utilized herein, is defined as readily extendible to a moderate strain without rupture in response to an applied stress. Preferably, the flexible belt should be capable of stretching to at least about 2.5 percent strain without exceeding its elastic limit. The expression "elastic limit" as employed herein is defined as the maximum elongation a material can be extended such that the material is able to retract precisely to its original dimension upon the release of the applied extension force. In general, the elastic limit is determined from the linear region of a stress-strain relationship plot in which the strain is directly proportional to the applied stress. Within this limit, a material under stress will retract and recover its original dimension due to elastic contraction as soon as the applied stress is removed.

The belt may comprise any suitable organic materials that are flexible and stretchable. The belt may comprise one or more layers of any suitable flexible and stretchable thermoplastic film forming polymer, thermosetting film forming polymer, metal, or the like. Typical thermoplastic film forming polymers include polyethylene, terephthalate polymers, polycarbonates, polysulfone, polyacrylates, polyarylates, polyvinylidene fluoride, polyvinyl chloride, polystyrene, and the like. Typical thermosetting polymers include rubbers, cross-linked polyurethanes, phenolic resins, epoxy resins, vulcanized rubbers, cross-linked silicones, and the like. The exposed surfaces of belts to be mounted over a flexible seamless carrier support sleeve for use in intermediate image transfer belt applications preferably comprise well known flexible and stretchable abhesive material. Typical abhesive materials include, for example, polymers such as fluorocarbon polymers, polysiloxanes, waxy polyethylene, waxy polypropylene, and the like.

For electrostatographic imaging belts having a seam, the outer circumference of the belt after mounting and stretching on the seamless carrier support sleeve and support rollers, for imaging applications, is preferably at least about as long as the width of the receiving member to which a toner image is transferred to ensure that the entire receiving member surface can be imaged with transferred toner material. Belts having a seam are usually formed by welding the overlapped ends of a cut sheet with the welded seam extending from one edge to the opposite edge of the imaging belt in a direction parallel to the axis of the belt. Generally, the outer circumference of a seamed belt is preferably at least about 22 centimeters in order to provide adequate surface area to accommodate the width of a conventional size toner image receiving member (i.e., a standard size 8.5 inch (22 cm)×11.5 inch (29 cm) paper). For electrophotographic imaging machines dedicated to forming images on envelopes, calling cards and the like, the outer circumference of the seamed belt should have a surface area at least sufficient for positioning conventional precessing stations such as a cleaning blade, a charging device, a development station, an erase lamp, and the like around the imaging belt/carrier support sleeve assembly. There is no apparent maximum limit to the circumference of the inner surface of the belt. However, with larger circumferences, handling of the belt during the mounting steps may become very cumbersome and somewhat difficult for a single worker. Normally, there is considerable latitude as to the circumferential dimension of the belt selected. Typically, for electrostatographic imaging applications, the circumference of the belt is slightly greater than about 8.5 inches (22 cm) to accommodate imaging on common receiving member surfaces. Typical circumferences for a seamed electrostatographic imaging belt are between about 22 cm and about 130 cm. A preferred range is between about 23 cm and about 110 cm. Optimum results are achieved with a range between about 45 cm and about 90 cm. If the belt is seamless, the inner circumference of electrostatographic imaging belts can be relatively small because there is no seam to disrupt the images being transferred to the receiving member, e.g. a standard letter size sheet. From a theoretical point of view, the inner circumference of the belt can be so small that it barely encircles a pair of closely spaced 1.9 cm diameter belt support rollers. This allows formation of images on one segment of the imaging surface of the belt while developed images from another segment of the imaging surface are being transferred. In more practical applications, a satisfactory circumferential dimension for a seamless electrostatographic imaging belt shall be sufficient for positioning all subsystems such as a cleaning blade, charging device, development station, erase lamp (in the case of electrophotography) and also shall have enough room for accommodating at least two 1.9 cm diameter supporting belt module rollers. Preferably the outer circumference of the imaging belt is at least about 10 cm. Optimum results are achieved for imaging belts having an outer circumference of at least about 12 cm.

Any suitable belt thickness may be utilized so long as a compression pressure of at least about 0.4 psi (28 gms/cm$^2$) can be radially exerted by the inner surface of the imaging belt against the outer surface of the carrier support belt while stretched and wrapped around part of the outer periphery of a drive-roll of the flexible belt assembly device when the flexible belt assembly device is tensioned and the support rollers have been moved apart for image formation as illustrated in FIGS. 3 and 5. Adequate compression pressure is important to prevent the imaging belt from slipping over the preformed flexible seamless carrier support sleeve during use. Belt slippage on the flexible carrier support belt renders the flexible belt assembly device undesirable for use in precision electrostatographic imaging systems, intermediate image transfer belts, sheet transport belts, document handling belts and the like. More specifically, slippage can adversely affect registration of images in electrostatographic imaging processes, particularly where multiple images must be precisely registered with each other such as in demanding color imaging applications. Also, when welded belt seams encounter slippage, undesirable sophisticated detection system would be required to ensure that images are not formed on the seam when the seam shifts its position in the belt assembly device due to slippage. Typical belt thicknesses fall with the range of between about 25 micrometers and about 250 micrometers. A preferred thickness is between about 50 micrometers and about 200 micrometers. An optimum belt thickness is between about 75 micrometers and about 130 micrometers.

The electrostatographic imaging belt may comprise only a single imaging layer if the imaging layer is sufficiently flexible and self supporting and can exert the desired compressive pressure of at least about 0.4 psi (28 gms/cm$^2$) in a radial direction onto the outer surface of the flexible seamless carrier support sleeve after the sleeve has been expanded to remove all slack and to stretch the imaging belt. Electrostatographic flexible belt imaging members are well known in the art. The imaging belt may be seamed or seamless. Typically, a flexible substrate of the imaging belt is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a charge transport layer is subsequently formed on the charge generation layer. For ionographic imaging members, an electrically insulating dielectric imaging layer is applied to the electrically conductive surface. The substrate may contain an optional anti-curl back coating on the side opposite from the side bearing the charge transport layer or dielectric imaging layer.

The belt substrate may be opaque or substantially transparent and may comprise numerous suitable materials having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, polysulfones, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar, available from E.I. du Pont de Nemours & Co. or Melinex available from ICI Americas, Inc. or Hostaphan, available from American Hoechst Corporation.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure through an transparent rigid cylindrical support drum, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a charge blocking layer may be applied thereto to photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, polyesters, duPont 49,000 (available from E. I. duPont de Nemours and Company), Vitel PE-100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones, dibromo anthanthrone pigments, benzimidazole perylene, substituted 2,4-diamino-triazines disclosed in U.S. Pat. No. 3,442,781, polynuclear aromatic quinones, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamide imides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of between about 0.1 micrometer and about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive thermoplastic resin binder soluble in methylene chloride or other suitable solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins having a molecular weight from about 20,000 to about 150,000, more preferably from about 50,000 to about 120,000. The material most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. Nos. 4,801,517, 4,806,444, 4,818,650, 4,806,443 and 5,030,532. Polyvinylcarbazole and derivatives of Lewis acids described in U.S. Pat. No. 4,302,521. Electrically active polymers also include polysilylenes such as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as Described in U.S. Pat. No. 3,870,516. The disclosures of each of the patents identified above pertaining to binders having charge transport capabilities are incorporated herein by reference in their entirety.

Other layers such as a conventional electrically conductive ground strip may be utilized along one edge of the belt in contact with the conductive layer, blocking layer, adhesive layer or charge generating layer to facilitate connection of the electrically conductive layer of the electrostatographic imaging member to ground or to an electrical bias through typical contact means such as a conductive brush, conductive leaf spring, and the like. Ground strips are well known and usually comprise conductive particles dispersed in a film forming binder. If at least one of the support members and the sleeve are electrically conductive, e.g. are metallic, the ground strip may be electrically connected to the sleeve by various means such as a stripe of any suitable electrically conductive glue or paint which extends from the ground strip located on the outwardly facing edge of the belt around to the back of the belt. The electrically conductive support member and sleeve would, of course, function as a path to ground or to an electrical bias source. Typical electrically conductive glues or paints comprise a film forming binder such as an epoxy or polyester resin highly loaded with dispersed electrically conductive particles such as silver powder. Alternatively, any suitable electrically conductive adhesive tape such as an aluminum tape may be utilized to connect the ground strip to the conductive sleeve. One end of the tape can be attached to the ground strip and the other end can be attached to the rear surface of the belt. Electrically conductive adhesive tapes are available commercially, e.g. No. 3142 available from Richards, Parents and Murray, Inc. In another embodiment, a small segment of the ground strip can be removed to expose the underlying conductive surface of the sleeve. An electrically conductive tape, paint or other suitable means may then be employed to connect the exposed conductive surface of the drum to the adjacent ground strip. In still another embodiment, a portion of the ground strip may be slit to allow folding of part of the ground strip so that the ground strip on the folded portion faces and is in direct electrical contact with the sleeve surface. It is preferred that these connectors not be applied to imaging areas of the electrostatographic imaging belt where they could interfere with imaging, cleaning, transfer or the like. No grounding strip is needed in connection with electrically conductive sleeves if an electrostatographic imaging member belt comprises only a charge generating layer and charge transport layer, or only a dielectric imaging layer.

Optionally, an overcoat layer may also be utilized to protect the charge transport layer and improve resistance to abrasion. In some cases an anti-curl back coating may be applied to the rear side of the substrate to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total curling forces of the imaging layer or layers on the opposite side of the supporting substrate layer.

Other typical electrophotographic imaging belts comprise a flexible electroformed nickel substrate, an adhesive layer and a vacuum deposited selenium alloy layer such as disclosed in U.S. Pat. No. 3,713,821, the entire disclosure thereof being incorporated herein by reference.

For electrographic imaging members, a flexible dielectric layer overlying the conductive layer may be substituted for the active photoconductive layers. Any suitable, conventional, flexible, stretchable, electrically insulating, thermoplastic dielectric polymer matrix material may be used in the dielectric layer of the electrographic imaging member. Typical electrographic imaging members are described in U.S. Pat. No. 5,073,434, the entire disclosure thereof being incorporated herein by reference.

For intermediate image transport belts, the belt normally has an exposed outer surface layer containing an abhesive polymer that is flexible and stretchable. Typical abhesive polymers include tetrafluoroethylene, polysiloxane, fluorinated polyethylene (e.g., Vitons), waxy polyethylene, waxy polypropylene, and the like such as disclosed in U.S. Pat. Nos. 4,196,256 and 5,049,444, the entire disclosures thereof being incorporated herein by reference. A typical intermediate image transport belt may comprise an electrically conductive support layer coated with an abhesive polymer layer.

Any suitable preformed flexible seamless sleeve having sufficiently precise dimensional tolerances may be employed for flexible seamless carrier support sleeve applications. The flexible seamless carrier support sleeve may comprise any suitable inorganic material, organic material, or a combination of inorganic and organic materials. Fabrication of a seamless flexible sleeves with precise dimensions is a well established technology. Typical inorganic flexible seamless carrier support sleeves comprise, for example, a metal belt such as an electroformed nickel belt. Especially preferred metal seamless carrier support sleeves are electroformed metal belts such as nickel belts. Electroformed metal belts are well known and described, for example in U.S. Pat. Nos. 3,905,400, 3,799,859, 3,844,906, the entire disclosures thereof being incorporated herein by reference. Typical organic flexible seamless carrier support sleeves comprise polymeric materials which may be prepared by any suitable well known technique such as extrusion molding blowing, preform blow molding, spray coating on a removable mandrel, and the like. Typical polymer belt fabrication processes are described, for example in U.S. Pat. Nos. 4,711,833, 4,747,992, 5,100,628, the entire disclosures thereof being incorporated herein by reference. Polymeric flexible seamless carrier support sleeves may be electrically nonconductive or conductive. Typical organic flexible seamless carrier support sleeves comprise a thermoplastic resin or a thermosetting resins or an elastomer such as highly elastic cross-linked elastomers. The resulting resin flexible seamless carrier support sleeve may contain a filler or fillers if desired. The region of the outer surface of the flexible seamless carrier support sleeve underlying the imaging belt should be substantially free of any irregularities which would distort the imaging surface of the electrostatographic imaging belt and adversely affect the quality of toner images formed on the imaging surface. Thus, for example, the particle size of any fillers used in a resin for flexible seamless carrier support sleeve applications should be sufficiently small so that the fillers do not project so far above the outer average surface of the flexible seamless carrier support sleeve because the projections adversely affect the quality of toner images formed on the imaging surface. Proper selection of a material for flexible seamless carrier support sleeve applications should have sufficient inherent mechanical strength and be sufficient to permit the flexible seamless carrier support sleeve to remain flexible and resist creep deformation during and after extended imaging belt machine cycling. In other words, the structural strength, flexibility and dimensional stability of the flexible seamless carrier support sleeve should be sufficient to prevent development of creep during extended periods of machine cycling as well as exhibiting no dynamic fatigue induced cracking in the sleeve when flexing over small diameter belt support rollers.

For flexible seamless carier support sleeves using polymeric materials, a thickness of from about 3 mils (76 micrometers) and about 40 mils (1,016 micrometers) is satisfactory. Preferrably, the thickness is between about 5 mils (127 micrometers) and about 30 mils (762 micrometers). Optimum thickness ranges from about 7 mils (178 micrometers) to about 20 mils (508 micrometers). For metallic flexible seamless carrier support sleeve applications, a satisfactory thickness is between about 2 mils (51 micrometers) and about 15 mils (381 micrometers) because the metal has a high Young's modulus. Preferrably, the thickness of metallic sleeves is between about 5 mils (127 micrometers) and about 12 mils (305 micrometers). An optimum thickness for metallic sleeves ranges from about 7 mils (178 micrometers) to about 10 mils (254 micrometers).

The circumferential size selected for the flexible seamless carrier support sleeve depends upon the belt assembly design and the type of imaging belt used. Thus, if a welded imaging belt is utilized and the minimum size of the receiving member to ultimately be imaged is 8.5 inches (21.6 cm) (i.e., standard size paper), the outer circumference of the seamless carrier support sleeve should be at least about 22 cm. For a seamless imaging belt, the outer circumference of the flexible seamless carrier support sleeve should be at least about 10 cm. The transverse dimension of the flexible seamless carrier support sleeve may be slightly less, the same as, or slightly greater than the width of the imaging belt. However, it is preferred that the edges of the flexible seamless carrier support sleeve underlie and align with the edges of the imaging belt.

Generally, the mounting of an imaging belt onto a flexible seamless carrier support sleeve is accomplished by sliding it over the flexible seamless carrier support sleeve. It is preferred that the flexible seamless carrier support sleeve be made precisely to have an outer circumferential dimension slight larger than the imaging belt to ensure that the preformed flexible imaging belt has an inner circumference of at least about 0.05 percent smaller than the outer circumference of the flexible seamless carrier support sleeve to exert the desired compression pressure of at least about 0.4 psi (28 gms/cm$^2$) at the inner surface of the imaging belt belt in a radial direction onto the outer surface of the flexible seamless carrier support sleeve for the region of the support sleeve supported by the belt drive roll when the flexible seamless carrier support sleeve is fully expanded, i.e. the inner circumference of imaging belt is substantially equal to the outer circumference of the carrier support sleeve. This is especially important when the flexible seamless carrier support sleeve is not stretched after the slack has been taken out by moving the support members apart. Whether the slack is merely removed from the carrier support sleeve or whether the carrier support sleeve is also stretched along with the imaging belt, the imaging belt should be sufficiently stretched to exert the desired compression pressure of at least about 0.4 psi (28 gms/cm$^2$) at the inner surface of the imaging belt belt in a radial direction onto the outer surface of the flexible seamless carrier support sleeve for the region of the support sleeve supported by the belt drive roll. Under these conditions, the frictional force generated between the contacting surfaces of the imaging belt and the seamless carrier support sleeve is sufficient to overcome the tangential force arising from mechanical interactions with various adjacent electrostatographic subsystems while the imaging belt assembly is being cycled in a machine. Embodiments of the imaging belt over a flexible seamless carrier support sleeve of the present invention are illustrated in Working Examples I through VI and the calculations for determining compression pressure are in Working Example V below.

Any suitable support member may be utilized to support the belt and support sleeve. Typical support members include rolls, skid plates, stationary rods, and the like. These support members may comprise any suitable material such as metal, plastic and the like, and combinations thereof. At least one of the support members should be moveable relative to the other support member or members to permit stretching of the belt. A drive roll is preferred to move the belt and sleeve during cycling. Movement of the support members toward or away from each other can be effected by any suitable means such as a two-way acting air cylinder, solenoid, mechanical linkage, spring, and the like.

The imaging members fabricated according to the present invention concept achieve more precise tolerances, exhibit little or no conicity and tracking problems, can be readily recycled, are less expensive, extend the cycling life of belts and the like.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

A photoconductive imaging member web was prepared by providing a titanium coated polyester (Melinex, available from ICI Americas Inc.) substrate having a thickness of 3 mils (76.2 micrometers) and applying thereto, using a gravure applicator, a solution containing 50 gms 3-aminopropyltriethoxysilane, 50.2 gms distilled water, 15 gms acetic acid, 684.8 gms of 200 proof denatured alcohol and 200 gms heptane. This layer was then allowed to dry for 5 minutes at 135° C. in a forced air oven. The resulting blocking layer had a dry thickness of 0.05 micrometer.

An adhesive interface layer was then prepared by applying with a gravure applicator to the blocking layer a wet coating containing 5 percent by weight based on the total weight of the solution of polyester adhesive (DuPont 49,000, available for E. I. du Pont de Nemours & Co.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.07 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 gms polyvinyl carbazole and 140 ml of a 1:1 volume ratio of a mixture of tetrahydrofuran and toluene into a 20 oz. amber bottle. To this solution was added 8 gram of trigonal selenium and 1,000 gms of ⅛ inch (3.2 millimeter) diameter stainless steel shot. This mixture was then placed on a ball mill for 72 to 96 hours. Subsequently, 50 gms of the resulting slurry were added to a solution of 3.6 gm of polyvinyl carbazole and 20 gm of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface by extrusion coating to form a layer having a wet thickness of 0.5 mil (12.7 micrometers). However, a strip about 3 mm wide along one edge of the substrate, blocking layer and adhesive layer was deliberately left uncoated by any of the photogenerating layer material to facilitate adequate electrical contact by the ground strip layer that is applied later. This photogenerating layer was dried at 135° C. for 5 minutes in a forced air oven to form a dry thickness photogenerating layer having a thickness of 2.0 microns.

This coated imaging member web was simultaneously overcoated with a charge transport layer and a ground strip layer by coextrusion of the coating materials. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbensabricken Bayer A. G. The resulting mixture was dissolved in 15 percent by weight methylene chloride. This solution was applied on the photogenerator layer by extrusion to form a coating which upon drying had a thickness of 24 micrometers.

A strip about 3 mm wide of the adhesive layer left uncoated by the photogenerator layer was coated with a ground strip layer during the coextrusion process. The ground strip layer coating mixture was prepared by combining 23.81 grams. of polycarbonate resin (Makrolon 5705, 7.87 percent by total weight solids, available from Bayer AG), and 332 gms of methylene chloride in a carboy container. The container was covered tightly and placed on a roll mill for about 24 hours until the polycarbonate was dissolved in the methylene chloride. The resulting solution was mixed for 15–30 minutes with about 93.89 grams. of a graphite dispersion (12.3 Percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser in a water cooled, jacketed container to prevent the dispersion from overheating and losing solvent. The resulting dispersion was then filtered and the viscosity was adjusted with the aid of methylene chloride. This ground strip layer coating mixture was then applied to the photoconductive imaging member to a form an electrically conductive ground strip layer having a dried thickness of about 14 micrometers. This ground strip may be electrically grounded by conventional means such as a carbon brush contact means.

The resulting photoreceptor device containing all of the above layers was annealed at 135° C. in a forced air oven for 5 minutes.

An anti-curl back coating was prepared by combining 88.2 gms of polycarbonate resin (Makrolon 5705, available from Bayer AG), 0.9 gm of polyester resin (Vitel PE-100, available from Goodyear Tire and Rubber Company) and 900.7 gms of methylene chloride in a carboy container to form a coating solution containing 8.9 percent solids. The container was covered tightly and placed on a roll mill for about 24 hours until the polycarbonate and polyester were dissolved in the methylene chloride. 4.5 gms of silane treated microcrystalline silica was dispersed in the resulting solution with a high shear disperser to form the anti-curl back coating solution. The anti-curl back coating solution was then applied to the rear surface (side opposite the photogenerator layer and charge transport layer) of the photoconductive imaging member web by extrusion coating and dried at 135° C. for about 5 minutes in a forced air oven to produce a dried film having a thickness of 13.5 micrometers.

EXAMPLE II

The surface contact friction of the anti-curl back coating of the photoconductive imaging member of Example I was evaluated against a smooth nickel surface to simulate frictional interaction between the imaging belt and flexible seamless carrier support sleeve as the imaging belt was carried and supported by a seamless flexible electroformed nickel sleeve to form the desired imaging belt/seamless carrier support sleeve assembly.

The coefficient of friction test was conducted by fastening the photoconductive imaging member to be tested to the flat surface of the bottom of a horizontally sliding 200 gram weight plate with the outer surface of the anti-curl back coating facing downwardly. The weight plate bearing the anti-curl back coating was dragged in a straight line against a smooth flat horizontal nickel test surface. The weight plate was moved by a cable which had one end fastened to the weight and the other end threaded around a low friction pulley. The pulley was positioned so that the segment of the cable between the weight and the pulley was parallel to the surface of the smooth flat horizontal nickel test surface. The cable was pulled vertically upward from the pulley by an Instron Tensile Test Instrument. The load in gms required to pull the weight plate and sliding it over the nickel surface was divided by 200 gms to give a coefficient of contact friction value of 0.26.

EXAMPLE III

The photoconductive imaging member web of Example I, having a width of 414 mm, was cut to a precise 591 mm length to form a rectangular sheet. The opposite ends of this imaging member sheet were overlapped 1 mm and joined by ultrasonic energy seam welding using a 40 KHz horn to form an imaging belt having an inner circumferential dimension of 590 mm as described in FIG. 1. This imaging belt was prepared to provide an inner circumferential dimension of about 0.5% smaller than the outer circumferential dimension of a flexible seamless carrier support sleeve which may be fabricated by electroforming nickel onto a removable cylindrical mandrel. This nickel flexible seamless carrier support sleeve may be slipped inside the imaging belt and mounted onto a bi-roller belt module as illustrated in FIG. 2. FIG. 3 shows an assembly of a tensioned imaging belt over the fully expanded nickel flexible seamless carrier support sleeve of the present invention. The bi-roller belt assembly shown in both Figures can consists of two 19 mm diameter rollers.

Figure 6:
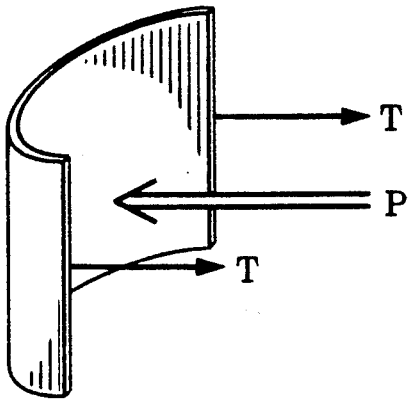
FIG. 6 is an isometric sectional view of an electrostatographic imaging belt being subjected to tension T and equilibrium pressure P.

Under a 0.5% wrap around strain and 180° wrapped angle, it is believed that the imaging belt will, according to calculations for the tension T and equilibrium pressure P schematically illustrated in FIG. 6, produce a 10.81 lbs/in (1932 gms per centimeter transverse belt width) tension to cause the belt to tightly hug onto the nickel seamless carrier support sleeve in the region wrapped around and in contact with the drive roll. This condition is calculated to produce an initial compression pressure of 28.81 psi (2,261 gms/cm$^2$) exerted radially by the imaging belt on the surface of the nickel flexible seamless carrier support sleeve.

EXAMPLE IV

At a constant 0.5 percent strain, the stress-relaxation characteristic of the imaging belt as a function of time after belt mounting over the rigid drum was investigated. Simulation of the effect of the constantly imposed 0.5 percent belt strain on stress response at the imaging belt/rigid drum interface was carried out by cutting two ½ in (1.27 cm) wide by 4 in (10.16 cm) long test samples of the imaging member described in Example I for stress-relaxation measurements, one test sample at 25° C. and the other at an elevated temperature of 50° C. The 25° C. measurement was intended to capture the stress-relaxation effect during the machine off period, whereas the elevated temperature testing at 50° C. was intended to duplicate the conditions during the time that the imaging belt/drum system of the present invention was under a machine operating mode.

The first test sample was evaluated for stress-relaxation behavior with respect to time, using the test procedures below:

Insert the test sample into the upper and the lower jaws of an Instron mechanical tester, leaving a 2 in (5.08 cm) sample gage length.

Under a controlled room ambient temperature of 25° C., stretch the test sample to an instantaneous 0.5% strain.

Monitor the change in tension response at the constant imposed 0.5% sample strain for 96 hours with a chart recorder.

The stress-relaxation measurement was repeated again by following the procedures described above for the second test sample, except that the testing was carried out under the elevated temperature of 50° C. To achieve and maintain this temperature condition, the Instron jaws with the test sample were enclosed in a temperature controlled chamber for the entire duration of the stress-relaxation measurement of 48 hours.

EXAMPLE V

The results obtained from the stress-relaxation measurements, monitored and recorded as a force-time curve on chart paper of a recorder at each temperature condition of 25° C. and 50° C. described in Example IV, were introduced into the following mathematical model:

$$S_t = S_o EXP - (t/\tau)\beta$$

wherein:

$S_t$ was the imaging member belt tension stress response at time t.

$S_o$ was the initially imposed imaging member tension.

t was the cumulative time in hours that the imaging member was under tension.

$\tau$ was the characteristic relaxation time constant for the imaging member.

$\beta$ was a characteristic constant.

Since $S_o$ was the known instantaneous sample tension as soon as the 0.5 percent strain was imposed at the beginning of the test and unlimited values of the transient sample tension were generated using the recorded force-time curve, the constants $\tau$ and $\beta$ were conveniently calculated by using the $S_o$ and two values of $S_t$ in the mathematical model given above. Although small variations in $\tau$ and $\beta$ results were obtained for the different sets of $S_t$ used in the calculations, averaging of the values of these results gave the best representation for matching the stress-relaxation mathematical model with the experimental force-time curve. Both the $\tau$ and $\beta$ were, therefore, empirically obtained values. At ambient and elevated temperature conditions, $\tau$ and $\beta$ were:

For 25° C.,
$\tau$ = 10,251.5 hours
$\beta$ = 0.3066

For 50° C.,
$\tau$ = 3,693.7 hours
$\beta$ = 0.2296

Thus, since each polymer has its own $\tau$ and $\beta$ constants, the value of the $\tau$ and $\beta$ constants are determined for each different polymer.

Assuming that an imaging belt had an electrical service life of one year; with 4 months cumulative time under 50° C. and 8 months at 25° C. ambient condition, the tension stress which was still retained in the imaging belt after a year of stress-relaxation (calculated using the above mathematical model) was 35.6 percent. This corresponded to the decrease in belt tension from the original value of 10.81 lb/in (1,932 gms/cm) to 3.85 lb/in (688 gms/cm) at the end of the service life of the imaging belt. With this imaging belt/flexible seamless carrier support sleeve combination, the system is analogous to the condition of a cylindrical pipe having a diameter D, wall tension T, and an internal pressurized fluid at an equilibrium pressure P as illustrated in FIG. 6. Using a one inch pipe length as a basis, the force balance under equilibrium conditions is:

$$P(D)(1in)=2(T)(1in)$$

Therefore, $$P=2T/D$$

where:

T is the wall tension in lbs/in and

D is the diameter of the pipe in inches.

In this case, T corresponds to the imaging belt tension, D corresponds to the diameter of the belt assembly drive roll supporting the segment of the imaging belt/flexible seamless carrier support sleeve, and P is the radial compression pressure exerted by the imaging belt on the surface of the nickel carrier belt. Accordingly, the value of this belt tension after a year under a service environment was calculated to yield a compression pressure of 10.267 psi (722 gms/cm$^2$) at the drum surface. Employing the frictional force equation:

$$F=\mu N$$

Where $\mu$, the coefficient of contact friction between the anti-curl back coating of the imaging belt and the nickel surface, was 0.26; and N, the normal force at the contacting surface, (based on 180° wrapped angle over a 19 mm diameter belt assembly drive roll and having a length of one inch) was equal to (10.267 lb/in$^2$) (1.1781 inch) (1 inch) or 12.10 lbs. Substituting the values of $\mu$ and N to the frictional equation, it gave:

$$F=(0.26)(12.10\text{ lbs})=3.15\text{ lbs per inch transverse belt width or 561.67 gms per centimeter transverse belt width}$$

Since this friction force was 25.2 times greater than the 0.125 lb per inch (22.3 gms/cm) width tangential force developed at the imaging member belt surface by cleaning blade and other mechanical subsystem interactions, the present imaging belt over flexible seamless carrier support sleeve invention ensures precision electrophotographic imaging performance under a service environment without encountering belt slippage.

EXAMPLE VI

The photoconductive imaging member web of Example I was cut to provide two sheets imaging members of precise dimensions, 355×642 mm. These imaging sheets were then fabricated into two imaging belts by following the same procedures of ultrasonic seam welding process described in Example III.

The first imaging belt was dynamically evaluated by cyclic testing in a belt support system which consisted of a 19 mm diameter drive roll and a 19 mm diameter curvature stationary aluminum skid plate having a spring backing to provide the desired one pound per inch width transverse belt tension (178.6 gms per centimeter transverse belt width). The imaging belt was then cycled, at a tangential belt speed of about 6 inches per second, to 10,000 cycles. Examination of the imaging surface of the belt at 100× magnification, using a reflection optical microscope, revealed circumferential bands of spider like cracks at the imaging surface of the belt. These cracks were found to be directly associated with bands of dirt accumulations/protrusions at the surface of the skid plate, since dirt protrusions above the skid plate surface were projected into the imaging member and cause formation of localized stress concentration spots thereby facilitating the development of the observed stress/fatigue induced crackings.

The dynamic test for the second imaging member belt was carried out by first mounting the imaging belt over a 5 mil thick polyethylene terephthlate flexible seamless carrier support sleeve having an outer circumference of about 0.05 percent larger than the inner circumference of the imaging belt. This imaging belt/flexible seamless carrier support sleeve combination was then mounted onto the belt support system to take the slack out from, but without stretching, the carrier support sleeve while simultaneously expanding the imaging belt to the point where the inner circumference of the imaging belt was substantially equal to the outer circumference of the carrier support sleeve. While maintaining the imaging belt in this stretched condition, it was dynamically cycled to 10,000 cycles according to the same testing conditions for the first imaging belt. No bands of imaging surface cracks were visible after the cyclic testing, demonstrating the effectiveness of the flexible seamless carrier support sleeve in protecting the imaging belt from the effect of stress concentration spots due to dirt accumulations/protrusions at the skid plate surface.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A method for supporting a preformed, continuous flexible belt comprising providing at least two support members maintained at a predetermined distance from each other, encircling said support members with at least one loosely hanging preformed flexible seamless carrier support sleeve having a predetermined outer circumference, encircling said seamless carrier support sleeve with a preformed, continuous flexible belt having an inner circumference substantially same as or less than said predetermined outer circumference of said seamless carrier support sleeve, and increasing said distance between said support members to stretch said flexible belt, the size of the inner circumference of said stretched flexible belt being substantially equal to the outer circumference of said seamless carrier support sleeve after stretching said flexible belt.

2. A method according to claim 1 including encircling said seamless carrier support sleeve with said flexible belt prior to encircling said support members with said seamless carrier support sleeve.

3. A method according to claim 1 including encircling said support members with said seamless carrier support sleeve prior to encircling said seamless carrier support sleeve with said flexible belt.

4. A method according to claim 1 wherein said seamless carrier support sleeve is stretched when increasing said distance between said support members to stretch said flexible belt.

5. A method according to claim 1 including maintaining said seamless carrier support sleeve substantially free of stretching strain when increasing said distance between said support members to stretch said flexible belt.

6. A method according to claim 1 wherein said flexible belt is an electrostatographic imaging belt having an outwardly facing imaging surface.

7. A method according to claim 1 including forming an electrostatic latent image on said imaging surface, developing said electrostatic latent image to form a toner image, and transfering said toner image to a receiving member.

8. A method according to claim 6 wherein said flexible belt is a belt having a welded seam extending transversely from one edge to the other edge in a direction parallel to the axis of said belt.

9. A method according to claim 8 wherein said electrostatographic imaging belt has an outer circumference of at least about 22 centimeters.

10. A method according to claim 6 wherein said flexible belt is a seamless belt.

11. A method according to claim 10 wherein said electrostatographic imaging belt has an outer circumference of at least about 10 cm.

12. A method according to claim 1 wherein said flexible belt comprises at least one flexible substrate support layer comprising a thermoplastic film forming polymer, an electrically conductive layer, a charge blocking layer, a charge generating layer and a charge transport layer.

13. A method according to claim 1 wherein said flexible belt is an intermediate image transport belt comprising a flexible, electrically conductive support substrate having an outwardly facing surface comprising an adhesive film forming polymer.

14. A method according to claim 1 wherein said seamless carrier support sleeve is electrically insulating.

15. A method according to claim 1 wherein said seamless carrier support sleeve is electrically conductive.

16. A method according to claim 1 wherein said seamless carrier support sleeve comprises an electroformed nickel sleeve.

17. A method according to claim 1 wherein at least one of said support members is a roller and the inner surface of said belt radially exerts a compression pressure of at least about 28 gms/cm$^2$ against the outer surface of said seamless carrier support sleeve in the region where said seamless carrier support sleeve bends around said roller after said inner circumference of said flexible belt is substantially equal to said outer circumference of said carrier support sleeve.

18. A method for supporting a preformed, continuous flexible belt imaging member comprising providing at least two support members maintained at a predetermined distance from each other, encircling said support members with at least one loosely hanging preformed flexible seamless carrier support sleeve having a predetermined outer circumference, encircling said carrier support sleeve with a preformed flexible belt having an inner circumference at least about 0.05 percent smaller than said outer circumference of said support sleeve, and increasing said distance between said members until said inner circumference of said flexible belt is substantially equal to said outer circumference of said carrier support sleeve.

19. A method according to claim 18 wherein said flexible belt is a belt having a welded seam extending transversely from one edge to the other edge in a direction parallel to the axis of said belt.

20. Apparatus for supporting a preformed, continuous flexible belt comprising at least two support members maintained at a predetermined distance from each other, at least one preformed flexible seamless carrier support sleeve encircling and loosely hanging from said support members, a preformed, continuous preformed flexible belt encircling said carrier support sleeve, and means to increase said distance between at least two of said support members to stretch said flexible belt and remove slack from said seamless carrier support sleeve.

* * * * *